US009894935B2

(12) United States Patent
Li et al.

(10) Patent No.: US 9,894,935 B2
(45) Date of Patent: Feb. 20, 2018

(54) ATOMIZING CORE AND ELECTRONIC CIGARETTE HAVING SAME

(71) Applicant: Shenzhen First Union Technology Co., Ltd., Shenzhen, Guangdong Province (CN)

(72) Inventors: Yonghai Li, Shenzhen (CN); Zhongli Xu, Shenzhen (CN); Long Cai, Shenzhen (CN); Hongxing Duan, Shenzhen (CN)

(73) Assignee: SHENZHEN FIRST UNION TECHNOLOGY CO., LTD., Shenzhen, Guangdong Province (CN)

( * ) Notice: Subject to any disclaimer, the term of this patent is extended or adjusted under 35 U.S.C. 154(b) by 292 days.

(21) Appl. No.: 14/813,035

(22) Filed: Jul. 29, 2015

(65) Prior Publication Data

US 2016/0029700 A1 Feb. 4, 2016

(30) Foreign Application Priority Data

Jul. 31, 2014 (CN) ..... 2014 2 0425838 U

(51) Int. Cl.

| | |
|---|---|
| ***A24F 47/00*** | (2006.01) |
| ***H05B 3/06*** | (2006.01) |
| ***H05B 3/00*** | (2006.01) |
| ***H05B 3/54*** | (2006.01) |

(52) U.S. Cl.

CPC ..... *A24F 47/008* (2013.01); *H05B 3/0014* (2013.01); *H05B 3/06* (2013.01); *H05B 3/54* (2013.01)

(58) Field of Classification Search

CPC ..... A24F 47/008; H05B 3/54; H05B 3/0014; H05B 3/06; H05B 1/0291

See application file for complete search history.

(56) References Cited

U.S. PATENT DOCUMENTS

| | | | | |
|---|---|---|---|---|
| 2012/0111347 | A1* | 5/2012 | Hon | A24F 47/008 131/329 |
| 2013/0180533 | A1* | 7/2013 | Kim | A24F 47/008 131/273 |
| 2014/0130796 | A1* | 5/2014 | Liu | A24F 47/008 128/202.21 |
| 2014/0130797 | A1* | 5/2014 | Liu | A24F 47/008 128/202.21 |
| 2014/0130816 | A1* | 5/2014 | Liu | A24F 47/008 131/329 |

(Continued)

FOREIGN PATENT DOCUMENTS

| | | | | |
|---|---|---|---|---|
| EP | 2979555 | A1 * | 2/2016 | A24F 47/008 |
| WO | WO 2013083634 | A1 * | 6/2013 | A24F 47/008 |
| WO | WO 2013155645 | A1 * | 10/2013 | A24F 47/008 |

OTHER PUBLICATIONS

International Search Report & Written Opinion for EP 2979555.*

*Primary Examiner* — Michael J Felton
*Assistant Examiner* — Jerzi H Moreno Hernandez
(74) *Attorney, Agent, or Firm* — Cheng-Ju Chiang

(57) ABSTRACT

An exemplary atomizing core includes a cylindrical main body and an atomizing rod. The cylindrical main body has a central axis. The cylindrical main body extends from the main body along the central axis. The main body and the atomizing rod are both made of porous bodies. The main body defines a through hole along the central axis.

9 Claims, 3 Drawing Sheets

(56) References Cited

U.S. PATENT DOCUMENTS

| | | | | |
|---|---|---|---|---|
| 2014/0196718 | A1* | 7/2014 | Li | A61M 11/041 128/202.21 |
| 2015/0136124 | A1* | 5/2015 | Aronie | A24F 47/008 128/202.21 |
| 2015/0296887 | A1* | 10/2015 | Zhu | A24F 47/008 131/329 |
| 2015/0313288 | A1* | 11/2015 | Liu | A24F 47/008 131/329 |
| 2016/0044963 | A1* | 2/2016 | Saleem | A24F 47/008 131/328 |

* cited by examiner

ATOMIZING CORE AND ELECTRONIC CIGARETTE HAVING SAME

TECHNICAL FIELD

The present invention relates to electronic cigarettes, and particularly to an atomizing core and an electronic cigarette using same.

BACKGROUND ART

A typical electronic cigarette includes a liquid storing component, a liquid absorbing component, and a heating wire. The heating wire is wound around the liquid absorbing component. The liquid absorbing component is usually made of glass fiber material. The liquid absorbing component is configured for absorbing tobacco liquid from the liquid storing component via capillary action. The heating wire heats the tobacco liquid to vaporize. However, the glass fiber material may be bad for human's body.

What is needed, therefore, is an atomizing core and an electronic cigarette using same, which can overcome the above shortcomings.

SUMMARY

An exemplary atomizing core includes a cylindrical main body and an atomizing rod. The cylindrical main body has a central axis. The cylindrical main body extends from the main body along the central axis. The main body and the atomizing rod are both made of porous bodies.

The main body defines a through hole along the central axis.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
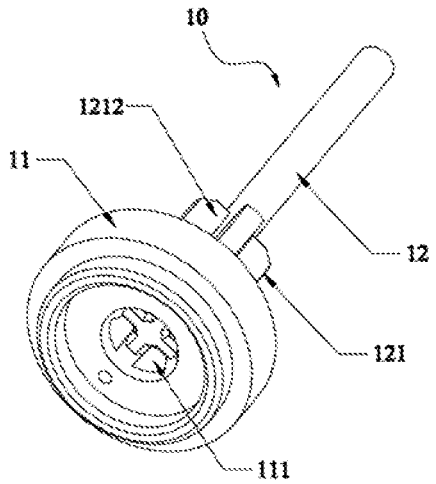
FIG. 1 is a perspective view of an atomizing core according to a first embodiment.
Figure 2:
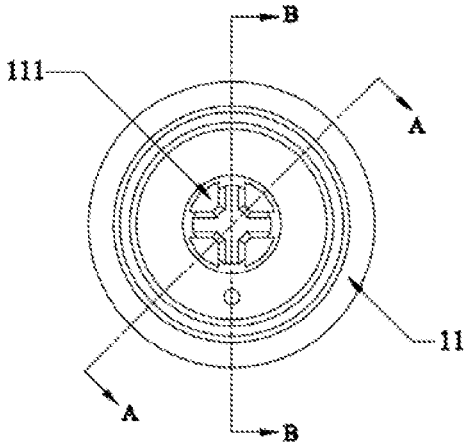
FIG. 2 is a side view of the atomizing core of FIG. 1.
Figure 3:
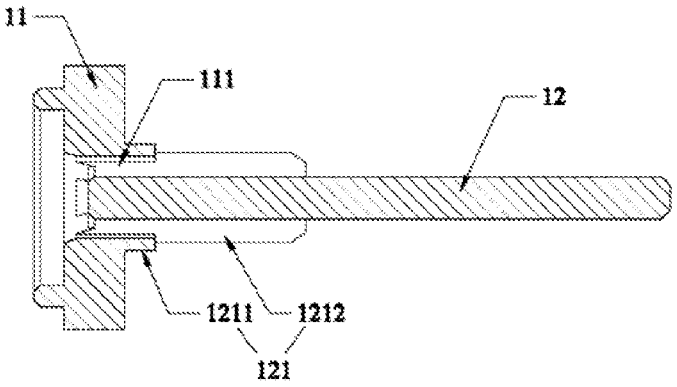
FIG. 3 is a cross-sectional view of the atomizing core taken along the line A-A.
Figure 4:
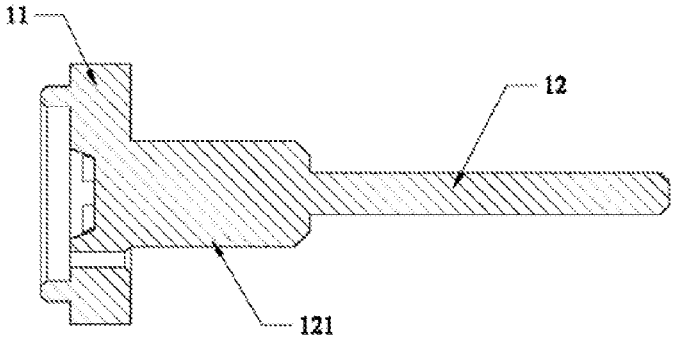
FIG. 4 is a cross-sectional view of the atomizing core taken along the line B-B.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Several definitions that apply throughout this disclosure will now be presented.

The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

Referring to FIGS. 1-4, an atomizing core 10 is shown. The atomizing core 10 includes a cylindrical main body 11 and an atomizing rod 12 extending from the main body 11 along a central axis of the main body 11. The main body 11 and the atomizing rod 12 are integrally formed by sintering porous ceramic. The main body 11 defines a plurality of through holes 111 along the central axis. The atomizing rod 12 is a solid body, and is arranged at a side of the main body 11 adjacent to the through holes 111. Air can go from one side of the main body 11 to the other side via the through holes 111.

The main body 11 includes a connector 121, and the main body 11 is connected with the atomizing rod 12 via the connector 121. The connector 121 includes a connecting part 1211 and a plurality of air slots 1212 defined in an end of the connector 121 adjacent to the atomizing rod 12. The air slots 1212 are oriented along a direction parallel to a central axis of the atomizing rod 12. The through holes 111 extend through the connecting part 1211 and are in communication with the air slots 1212.

In the present embodiment, the atomizing core 10 includes four air slots 1212 equiangularly along a circumference of the connector 121. The atomizing core 10 has a symmetric shape.

To achieve a symmetric design, the main body 11 is substantially cylindrical. The atomizing rod 12 is oriented along the central axis of the main body 11.

Figure 5:
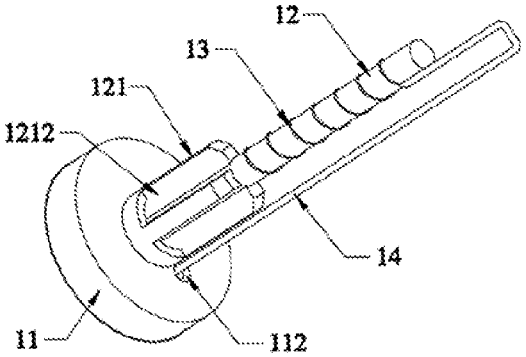
FIG. 5 is a perspective view of an atomizing core according to a second embodiment.

Referring to FIG. 5, the atomizing core 10 further includes a heating wire 13 wound around the atomizing rod 12. After the atomizing rod 12 absorbs tobacco liquid, the heating wire 13 heats the tobacco liquid to form aerosol. The atomizing core 10 is made of porous ceramic.

Figure 6:
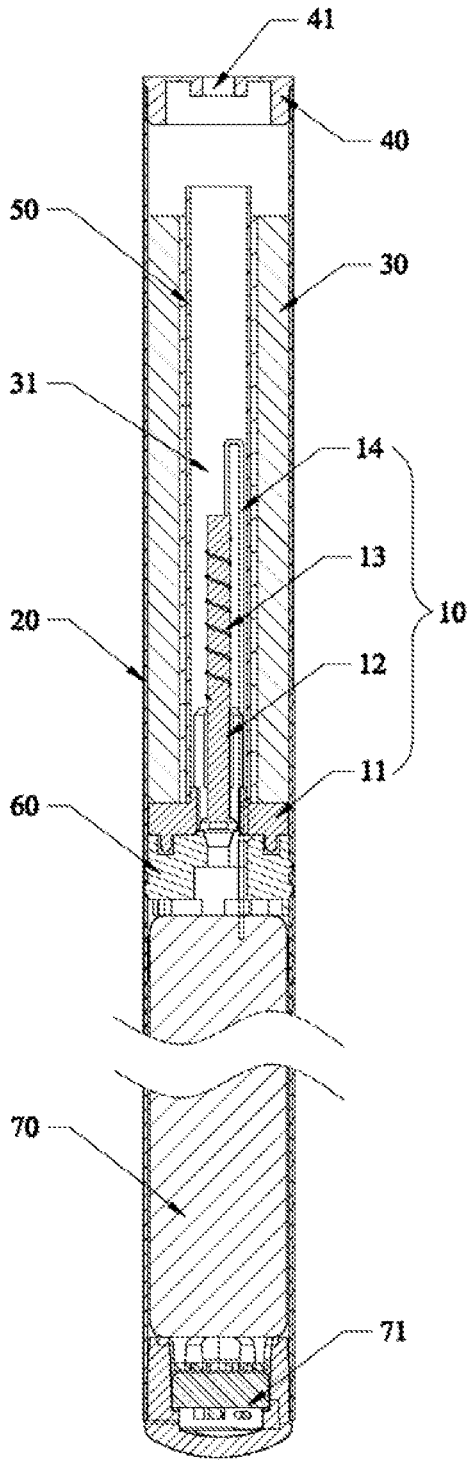
FIG. 6 is a cross-sectional view of an electronic cigarette according to a third embodiment.

Referring to FIGS. 5-6, an electronic cigarette includes a housing 20, a liquid storing component 30 in the housing 20, and the atomizing core 10. The liquid storing component 30 defines an air passage 31 along a central axis. An end of the liquid storing component 30 tightly abuts against the main body 11, so that the main body 11 absorbs tobacco liquid from the liquid storing component 30. The atomizing rod 12 and the heating wire 13 are positioned in the air passage 31.

The tobacco liquid absorbed in the main body 11 penetrates the atomizing rod 12 via porous structure, and the heating wire 13 heats the tobacco liquid in the atomizing rod 12 to form aerosol. The aerosol is expelled through the air passage 31.

An end of the housing 20 is provided with a mouthpiece 40. The mouthpiece 40 defines an air outlet 41, through which a user of the electronic cigarette inhales the aerosol.

The electronic cigarette further includes an air pipe 50, and the air passage 31 is defined in the air pipe 50. The atomizing core 10 is nested in the air pipe 50, and the connector 121 is engaged in one end of the air pipe 50. The air pipe 50 separates the aerosol from the tobacco liquid in the liquid storing component 30, preventing the tobacco liquid from deteriorating.

In the present embodiment, the atomizing rod 12 is substantially cylindrical. A diameter of the atomizing rod 12 is less than an inner diameter of the air pipe 50, so that the aerosol can go through a gap formed between the atomizing rod 12 and the air pipe 50. Furthermore, the heat of the heating wire 13 will not be conveyed directly to the tobacco liquid in the liquid storing component 30, thus preventing the tobacco liquid from deteriorating.

The electronic cigarette further includes a liquid stopper 60. An end of the liquid stopper 60 abuts against the main body 11, and is engaged in the housing 20 by interference fit, avoiding tobacco liquid leakage. Two opposite ends of the heating wire 13 are connected with wires 14 respectively, and the wires 14 are connected to a power supply (70, see FIG. 6). Correspondingly, the liquid stopper 60 defines at least one wire hole allowing the wires 14 to pass through. The main body 11 of the atomizer core 10 also defines at least one wire hole 112 for allowing the wires to pass through.

In the present embodiment, the electronic cigarette is a one-piece electronic cigarette. The electronic cigarette further includes a power supply 70. The mouthpiece 40, the liquid storing component 30, the liquid stopper 60 and the power supply 70 are sequentially arranged in the housing 20. The wires 14 pass through the liquid stopper 60, and are then connected to the power supply 70. The power supply 70 is configured (i.e., structured and arranged) for supplying the heating wire 13 power.

The power supply 70 further includes an air actuating electronic switch 71. When the user sucks from the air outlet 41, air goes in from an end of the housing 20, and then the air actuating electronic switch 71 is turned on, so that the power supply 70 feeds the heating wire 13 power. The heating wire 13 heats the tobacco liquid to form aerosol, and then the aerosol is inhaled by the user. After the aerosol is cooled to form liquid drops, the liquid drops flow along an inner wall of the air pipe 50 to the main body 11, the main body 11 absorbs the liquid drops for evaporation. Accordingly, the liquid leakage is greatly improved or eliminated. Furthermore, a liquid absorbing rate can be controlled by changing a size of the atomizing core, and a density of holes (not shown) in the atomizing core.

It is understood that the above-described embodiments are intended to illustrate rather than limit the disclosure. Variations may be made to the embodiments and methods without departing from the spirit of the disclosure. Accordingly, it is appropriate that the appended claims be construed broadly and in a manner consistent with the scope of the disclosure.

What is claimed is:

1. An atomizing core, comprising:

a cylindrical main body having a central axis;

a solid non-hollow atomizing rod extending from the main body along the central axis, wherein the main body and the atomizing rod are both made of porous bodies, the main body defining a through hole extending longitudinally along a direction parallel to the central axis and disposed beside the atomizing rod away from the central axis for airflow passing; and a heating wire wound around the atomizing rod for heating tobacco liquid in the atomizing rod to form aerosol.

2. The atomizing core according to claim 1, wherein the main body comprises a connector at an end, the connector is configured for connecting with the atomizing rod, the connector defines a plurality of air slots extending along a direction parallel to the central axis, and the air slots are in communication with the through hole.

3. The atomizing core according to claim 2, wherein a quantity of the air slots is four, and the four air slots are equiangularly arranged along a circumference of the connector.

4. The atomizing core according to claim 1, wherein the atomizing core is made of ceramic.

5. The atomizing core according to claim 1, wherein the main body and the atomizing rod are integrally formed.

6. An electronic cigarette comprising:

a housing;

a liquid storing component configured for reserving tobacco liquid, the liquid storing component being received in the housing, and defining an air passage therein;

an atomizing core comprising:

a cylindrical main body having a central axis;

an atomizing rod extending from the main body along the central axis, wherein the main body and the atomizing rod are both made of porous bodies, the main body defining a through hole next to the atomizing rod and extending along a direction parallel to the central axis; and a heating wire wound around the atomizing rod for heating tobacco liquid to form aerosol;

a power supply accommodated in the housing, wherein the power supply is configured for supplying the heating wire power;

wherein an end of the main body of the atomizing core abuts against a corresponding end of the liquid storing component, the atomizing rod and the heating wire are positioned in the air passage and spaced from inner walls of the liquid storing component, wherein the main body is configured for absorbing the tobacco liquid from the liquid storing component and conveying the tobacco liquid to the atomizing rod, and the heating wire is configured for heating the tobacco liquid in the atomizing rod to vaporize.

7. The electronic cigarette according to claim 6, further comprising an air pipe extending inside the liquid storing component, wherein the air passage is defined in the air pipe, an end of the air pipe abuts against the main body, and the atomizing rod and the heating wire are received in the air pipe and spaced from inner walls of the air pipe.

8. The electronic cigarette according to claim 7, wherein the atomizing rod is substantially cylindrical, and a diameter of the atomizing rod is less than an inner diameter of the air pipe.

9. The electronic cigarette according to claim 6, further comprising a liquid stopper, wherein the liquid stopper abuts against an end of the main body away from the atomizing rod, the liquid stopper is engaged in the housing by interference fit, and the liquid stopper is configured for blocking the tobacco liquid in the main body retrieved from the liquid storing component from the power supply.

* * * * *